US008231247B2

(12) United States Patent
Olmsted

(10) Patent No.: US 8,231,247 B2
(45) Date of Patent: Jul. 31, 2012

(54) MOVEABLE BARRIER OPERATOR HAVING DIRECTIONAL LIGHT SOURCES AND CORRESPONDING METHOD

(75) Inventor: Robert John Olmsted, Wood Dale, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 409 days.

(21) Appl. No.: 11/939,257

(22) Filed: Nov. 13, 2007

(65) Prior Publication Data

US 2009/0122534 A1 May 14, 2009

(51) Int. Cl.
*F21V 19/02* (2006.01)

(52) U.S. Cl. ..... 362/285; 362/249.03; 362/249.02; 340/815.48

(58) Field of Classification Search ..... 362/45, 362/238, 240, 249, 253, 145, 249.01, 249.02, 362/249.03, 285–287; 340/815.49, 815.4, 340/815.45
See application file for complete search history.

(56) References Cited

U.S. PATENT DOCUMENTS 3,427,521 A 2/1969 Goldstein
5,522,638 A * 6/1996 Falcoff et al. ..... 296/37.8
5,589,747 A 12/1996 Utke
6,982,652 B2 1/2006 Laird
7,057,547 B2 6/2006 Olmsted et al.
7,145,470 B2 * 12/2006 Hoermann ..... 340/815.49
7,265,508 B1 * 9/2007 Karasek et al. ..... 318/280
2003/0214806 A1 11/2003 Laird et al.
2004/0246721 A1 12/2004 Hoermann
2007/0121316 A1 5/2007 Hoermann

FOREIGN PATENT DOCUMENTS

GB 2 414 041 A 11/2005
GB 2 436 716 A 10/2007

OTHER PUBLICATIONS

Specification Sheet; www.cooperlighting.com; H7 Family Trims; Eyeballs; Page of Catalog; Publication (Date Unknown).
Search Report Under Section 17; British Patent Application No. GB0820840.7 Dated Feb. 25, 2009.

* cited by examiner

*Primary Examiner* — Hargobind S Sawhney
(74) *Attorney, Agent, or Firm* — Fitch Even Tabin & Flannery LLP

(57) ABSTRACT

A moveable barrier operator includes a motor for moving a moveable barrier and a housing is disposed around the motor. The moveable barrier operator also includes a plurality of light sources and the plurality of light source are coupled to the housing along a periphery of the housing and being individually directable so as to illuminate at least one predetermined area outside the housing. The at least one predetermined area is proximal to a moveable barrier operator. A controller disposed in the housing and coupled to the motor. The controller is arranged and configured to automatically selectively actuate the motor to move the moveable barrier according to received user instructions.

16 Claims, 6 Drawing Sheets

MOVEABLE BARRIER OPERATOR HAVING DIRECTIONAL LIGHT SOURCES AND CORRESPONDING METHOD

FIELD OF THE INVENTION

The field of the invention relates to moveable barrier operators and, more specifically, to light sources used with moveable barrier operators.

BACKGROUND

Different types of moveable barrier operators have been sold over the years and these barrier operator systems have been used to actuate various types of moveable barriers. For example, garage door operators have been used to move garage doors and gate operators have been used to open and close gates.

Such barrier movement operators may include various mechanisms to open and close the barrier. For instance, a wall control unit may be coupled to the barrier movement operator and send signals to a head unit thereby causing the head unit to open and close the barrier. In addition, operators often include a receiver unit at the head unit to receive wireless transmissions from a hand-held code transmitter or from a keypad transmitter, which may be affixed to the outside of the area closed by the barrier or other structure.

Light sources have been used with previous moveable barrier operator systems. For example, light bulbs have been used with garage door operators so that users may be provided with general illumination of their garage. In addition, these light sources sometimes helped to enhance the security of an area, for example, allowing a user to see if there was an intruder present in the illuminated area.

The light sources of these previous systems were typically mounted outside of the moveable barrier operator. More specifically, these light sources were generally mounted in a front-to-back or side-to-side locations to provide general lighting of the area of the garage. While these light sources sometimes give generally good overall lighting of the garage, they could not be directed to illuminate specific areas. Consequently, these systems were inefficient to use because areas of no interest might be illuminated while areas of high interest might not be sufficiently illuminated. Some other previous systems have used partial reflectors, which could be repositioned through hands-on physical manipulation by an end user to alter the pattern of light emitted from a light source. Although the use of these reflectors allowed for some modification to the light patterns produced, the use of reflectors increased the cost of the system and, in any event, the reflectors could not redirect light so as to illuminate precise areas that changed over time.

SUMMARY

Approaches are provided whereby directed light sources are positioned with a moveable barrier operator and are potentially mounted within the cover of the operator. These directed light sources can be adjusted manually and/or the number and identity of the light sources selected to be illuminated can be changed to illuminate selected areas of interest. In other words, the general direction of illumination and the areas illuminated can change automatically by controlling the particular group of lights that are illuminated. Additionally, selected lights can be moved automatically (e.g., by a motor) to change the direction of illumination. The approaches described herein are easy to use and illuminate particular areas of interest when requested or needed by a user. As the needs of the user change, the areas that are illuminated can also be changed. In so doing, the comfort, security, and safety of the user are enhanced.

By providing a number of directional lights, the lights can be illuminated in groups. By selecting different groups, the direction that lights are illuminating and the areas illuminated can be changed. As an example, in a garage door operator system, when the garage door operator is activated to open the garage door, the lights directed towards the door may not illuminate for a period in time to allow a vehicle to be moved into a garage. Then, after a time period has expired, these same lights are illuminated so that the driver of the vehicle can view the garage in the vicinity of the door (e.g., to determine whether an intruder is present) prior to leaving the vehicle. Other lights may illuminate different areas for different time periods.

In many of these approaches, a moveable barrier operator includes a motor for moving a moveable barrier and a housing that is disposed around the motor. The moveable barrier operator also includes a plurality of light sources and the plurality of light source are coupled to the housing along a periphery of the housing and are individually directable so as to illuminate one or more predetermined areas outside the housing. As used herein, it will be understood that the expression "predetermined area" refers to a specific area where an installer, end user, or other person wishes to have illumination and which is so identified prior to individually directing any of the plurality of light sources so as to illuminate this specific area. The predetermined area or areas are proximal to a moveable barrier operator. A controller is disposed in the housing and coupled to the motor. The controller is arranged and configured to automatically and selectively actuate the motor to move the moveable barrier according to received user instructions.

As mentioned, the plurality of light sources may be configured and arranged to each be individually directable so as to illuminate multiple areas. These multiple areas may or may not overlap. In another example, only a single area may be illuminated.

In some of these embodiments, the housing of the operator includes a bottom surface and the light sources are coupled to a periphery of this bottom surface. In other examples, the bottom surface includes a plurality of recesses formed therein and the light sources are disposed within the plurality of recesses. In still other examples, the housing includes one or more side surfaces and the plurality of light sources are secured to a periphery of one or more of these side surfaces.

In some of these approaches, the controller is coupled to the plurality of light sources and the controller is configured and arranged to respond, at least in part, to received user instructions by selectively controlling the illumination for one or more of the plurality of light sources. In some examples, the received user instructions identify the one or more light sources. In other examples, a specific set of the adjustable directed light sources may be illuminated.

Thus, approaches are provided whereby light sources are positioned with a moveable barrier operator and are automatically directed to illuminate an areas or areas of interest to a user. The approaches described herein are easy and efficient to use and illuminate particular areas of interest when requested by a user.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DESCRIPTION

Figure 1:
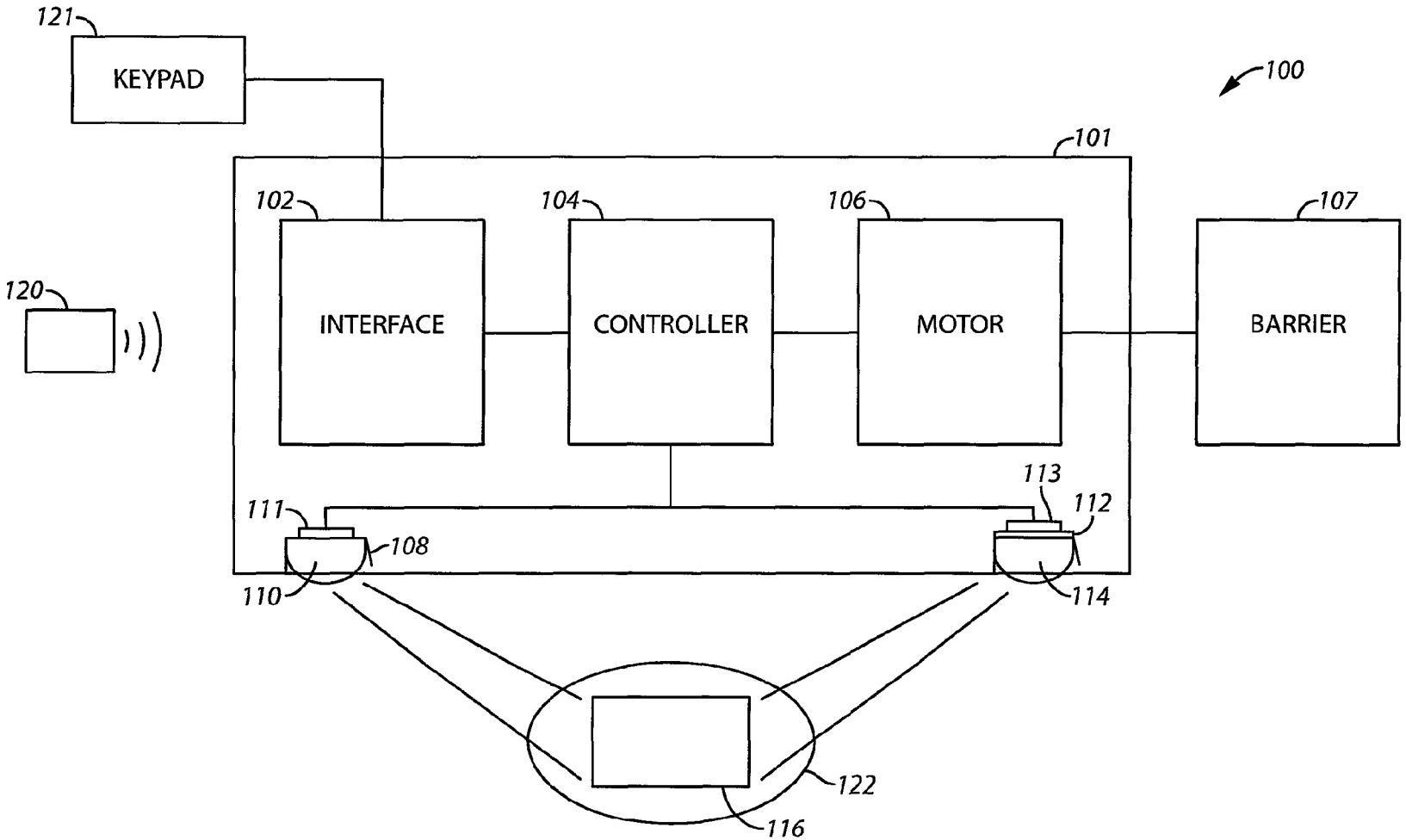
FIG. 1 comprises a block diagram of a system for using directional light sources with a moveable barrier with the light sources directed to illuminate an area according to various embodiments the present invention.

Referring now to FIG. 1, one example of a system for illuminating one or more directional light sources is described. A moveable barrier operator 100 includes a housing 101. Within the housing 101 are disposed an interface 102, a controller 104, and a motor 106. The interface 102 receives transmissions from a transmitter 120 or from a keypad 121 and converts these transmissions into a format useable by the controller 104. For example, radio frequency (RF) signals may be received from the transmitter 120 and converted by the interface 102 into a digital format. In another example, analog electrical signals may be received from the keypad 121 and converted into a digital format. The controller 104 is coupled to the motor 106 and to the light sources 110 and 114.

The controller 104 receives instructions as to how to move or operate a barrier 107. For example, instructions may be received to open, close, or halt the movement of the barrier 107. The barrier 107 may be any type of barrier such as a garage door, swinging gate, sliding gate, or shutters. Other examples of barriers are possible. After receiving commands or instructions, the controller 104 converts these commands and instructions into signals to operate the motor 106 (according to these commands and instructions) thereby actuating the barrier 107. It will be understood that other types of devices may be coupled to the moveable barrier operator 100. For example, obstruction detection devices may be coupled to the operator 100 in order to detect instructions in the path of the barrier 107. Other types of devices may also be coupled to the operator 100. Commands and instructions are also received to adjust the area or areas illuminated, direction of illumination, and/or other characteristics of the light sources 110 and 114.

In this example, the light sources 110 and 114 are disposed within recesses or openings 108 and 112 within the housing 101 of the operator 100. Alternatively, the light sources 110 and 114 may be coupled to the exterior of the housing 101. Additionally, although only two light sources are shown in the example of FIG. 1, it will be appreciated that any number of light sources may be used.

The light sources 110 and 114 may be any type of light emitting device such as a conventional incandescent light bulb, a compact florescent light source, or one or more light emitting diodes (LEDs). Other examples of light sources are possible. In other approaches, the brightness, color, or other operating characteristics of the light sources may be adjustable and these characteristics and changes to these characteristics can also be specified in user instructions received by the operator 100.

Figure 2:
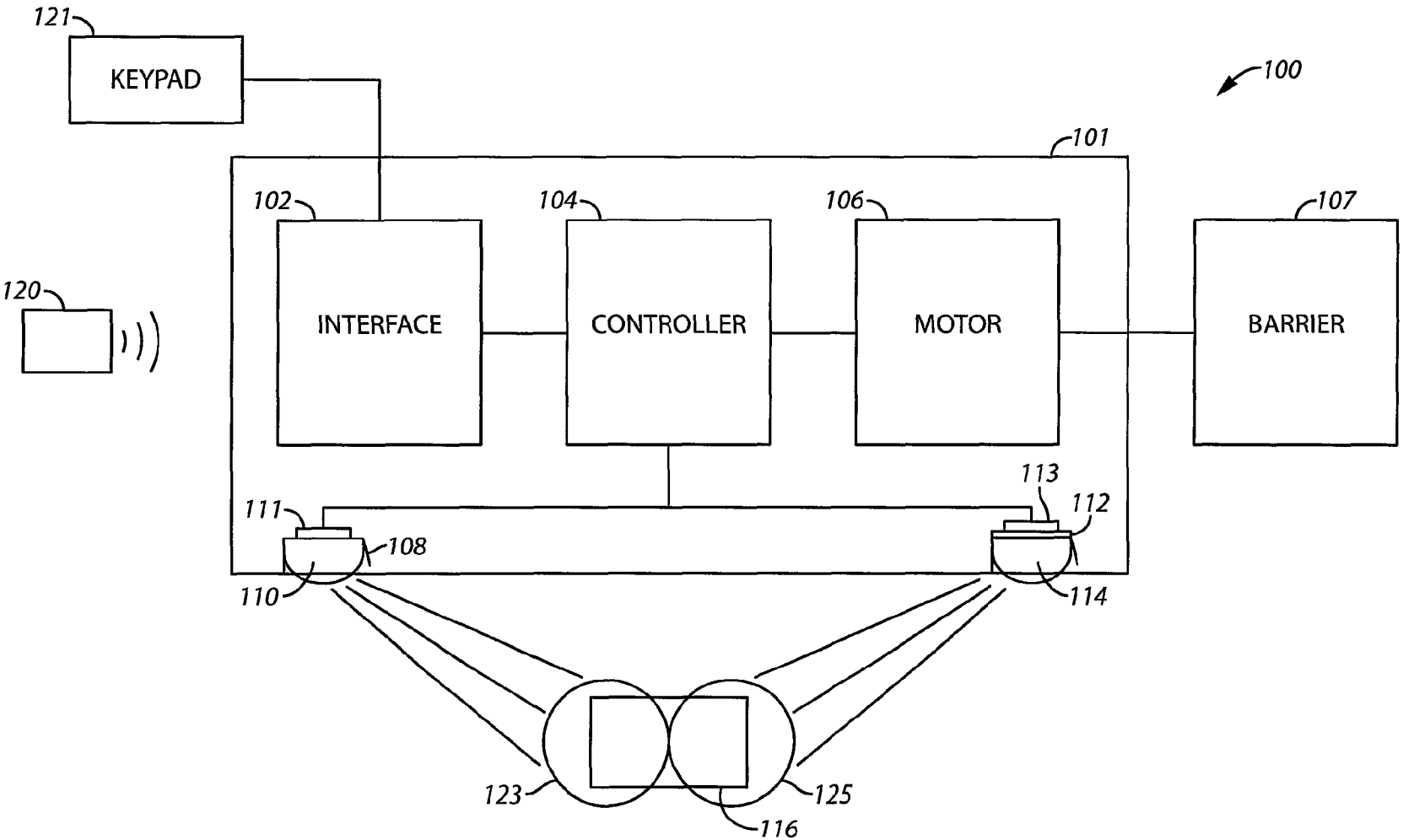
FIG. 2 comprises a block diagram of a system for using directional light sources with a moveable barrier with the light sources directed to illuminate another area according to various embodiments of the invention.

The light sources 110 and 114 are individually illuminated under the control of the controller 104 (having received user instructions) to illuminate areas in proximity to the operator 100. In the example of FIG. 1, the light sources 110 and 114 illuminate area 122 and an object 116 within the area 122. In FIG. 2, the light sources have been redirected. Object 116 is still being illuminated by both light sources, but now light source 110 illuminates one section of object 116 by illuminating area 123 and light source 112 illuminates a second section of object 116 by illuminating area 125.

The directional adjustment of the light sources 110 and 114 may be accomplished in a variety of different ways. For example, the angle of illumination of the light source with respect to the operator may be manually adjusted. In another example the choice as to which light sources to illuminate changes the perceived angle as in FIG. 2 when switching from light source 110 to light source 112. In another example, the controller 104 may store a table that maps user indicated directions/instructions into adjustment angles for the light sources. Each light source 110 and 114 may also have an associated adjustment motor 111 and 113 (or similar device) that turns or adjusts the illumination direction of the light source along different axes. These adjustment angles may be used by the adjustment motor 111 or 113 to adjust the light source as indicated by the adjustment angle. It will be appreciated that the use of adjustment angles to direct and re-direct the light sources 110 and 114 is only one approach that can be used to adjust the direction of illumination. For example, mirrors and/or directional lenses can be similarly utilized to effect a modification of the angle of illumination.

In addition, the light sources 110 and 114 are configured and arranged to each be individually directable so as to illuminate multiple areas and these multiple areas may or may not overlap. The controller 104 may also be preprogrammed to illuminate default areas (e.g., the light sources 110 and 114 may illuminate predetermined areas at least initially) and these areas may be changed by the receipt of user instructions. The instructions may be received from any source at the interface 102. As mentioned, the instructions may be received as RF signals from the transmitter 120 or they may be received as analog or digital signals from the keypad 121. In still other examples, voice instructions from a user may be received by the operator 101 and the operator 100 may include functionality (e.g., hardware or software residing in the interface 102 and/or the controller 104) to convert the received speech into directional adjustments associated with the light sources 110 and 114.

In the example of FIG. 1, the housing 101 includes a bottom surface and the light sources are coupled to a periphery of the bottom surface. In still other examples, the light sources 110 and 114 are secured to a periphery of one or more side surfaces of the housing 101. Alternatively, the light sources 110 and 114 may be arranged according to any predetermined pattern or arrangement. For example, the light sources can be arranged in a line, triangle, circle, or square, to name only a few possible patterns.

The user instructions may be transmitted in any type of format to the operator 100 and communicate any type of information that is necessary or helpful to adjust the light sources. For example, the user instructions may expressly name or identify a particular area to be illuminated and include the identity or identities of the light source or sources needed to illuminate the area or areas. As mentioned, various characteristics of the light sources (e.g., brightness levels, colors, and/or the rate at which the source of illumination reaches its full illumination) may also be adjusted. Furthermore, the instructions may also include or incorporate barrier movement commands. Alternatively, barrier movement commands may be received separately from commands that alter the directional illumination of the light sources 110 and 114.

Figure 3:
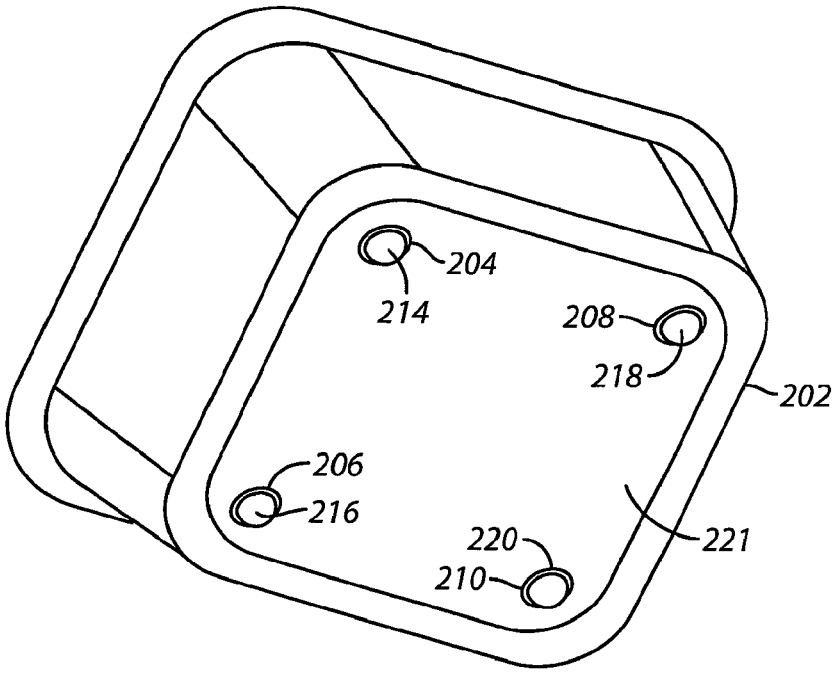
FIG. 3 comprises a perspective view of a moveable barrier operator having directional light sources according to various embodiments of the present invention.

Referring now to FIG. 3, a perspective view of a moveable barrier operator with directional light sources is described. An operator 202 includes a bottom surface 221 which includes recesses or openings 204, 206, 208, and 210 that are positioned along a periphery of the moveable barrier operator 202. Disposed within the recesses 204, 206, 208, and 210 are light sources 214, 216, 218, and 220. The light sources 214, 216, 218, and 220 are any type of light source such as a light bulb, compact florescent light, or LED to name three examples. Alternatively, the light sources 214, 216, 218, and 220, may be coupled to the bottom surface 221 and not disposed within any openings or recesses.

Figure 4:
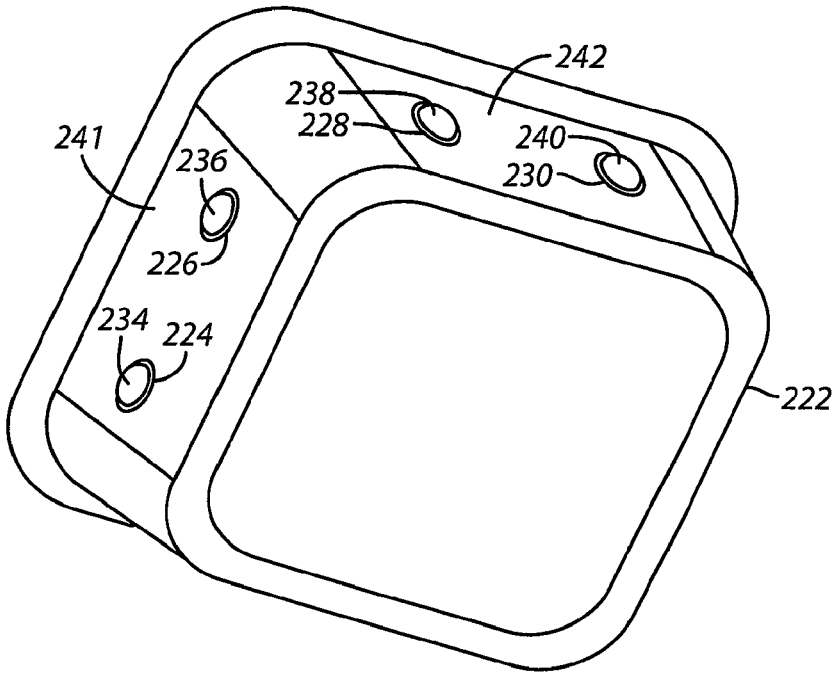
FIG. 4 comprises a perspective view of another example of a moveable barrier operator having directional light sources according to various embodiments of the present invention.

Referring now to FIG. 4, a perspective view of another example of a moveable barrier operator with directional light sources is described. An operator 232 includes side surfaces 241 and 242 which include recesses or openings 224, 226, 228, and 230 that are positioned along a periphery of the moveable barrier operator 232. Disposed within the recesses 224, 226, 228, and 230 are light sources 234, 236, 238, and 240. The light sources 234, 236, 238, and 240 are any type of light source such as a light bulb, compact florescent light, or LED to name three examples. Alternatively, the light sources 234, 236, 238, and 240 may be coupled to the side surfaces 241 and 242 and not disposed within any openings or recesses. The operator 232 includes four side surfaces and two are shown in this example. However, it will be appreciated that other light sources may be attached to the other side surfaces (or disposed in recesses within these side surfaces). It will also be appreciated that a given operator may have a greater, or fewer, number of clearly discernable side surfaces.

Figure 5:
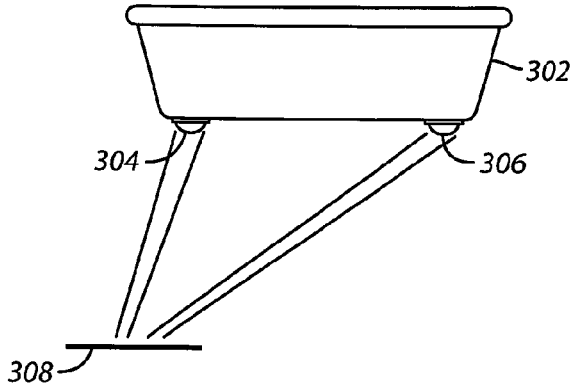
FIG. 5 comprises a diagram of a moveable barrier operator having directional light sources illuminating a single area according to various embodiments of the present invention.

Referring now to FIG. 5, a moveable barrier operator with directional light sources illuminating a single area is described. In this example, a moveable barrier operator 302 includes light sources 304 and 306 that are disposed in recesses within the operator 302. As shown, the light sources 304 and 306 are directed to illuminate a single area 308.

Figure 6:
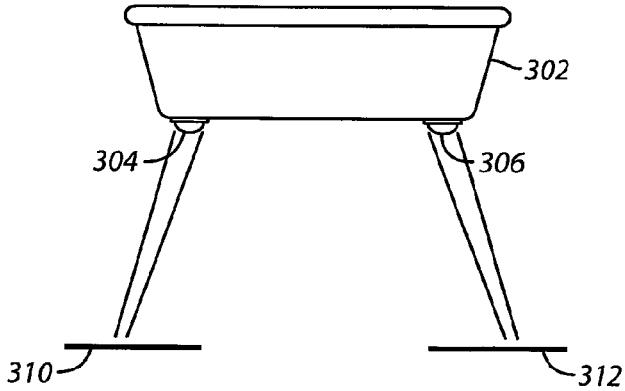
FIG. 6 comprises a diagram of a moveable barrier operator having directional light sources illuminating multiple, non-overlapping areas according to various embodiments of the present invention.

Referring now to FIG. 6, a moveable barrier operator with directional light sources illuminating multiple, non-overlapping areas is described. In this example, a moveable barrier operator 302 includes light sources 304 and 306 that are disposed in recesses within the operator 302. As shown, the light sources 304 and 306 are directed to illuminate a first area 310 and a second area 312. The areas 310 and 312 do not overlap each other.

Figure 7:
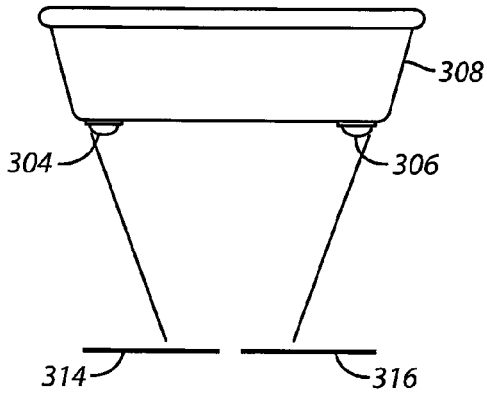
FIG. 7 comprises a diagram of a moveable barrier operator having directional light sources illuminating multiple, overlapping areas according to various embodiments of the present invention.

Referring now to FIG. 7, a moveable barrier operator with directional light sources illuminating multiple, overlapping areas is described. In this example, a moveable barrier operator 302 includes light sources 304 and 306. As shown, the light sources 304 and 306 are directed to illuminate a first area 314 and a second area 316. The areas 314 and 316 overlap each other.

Figure 8:
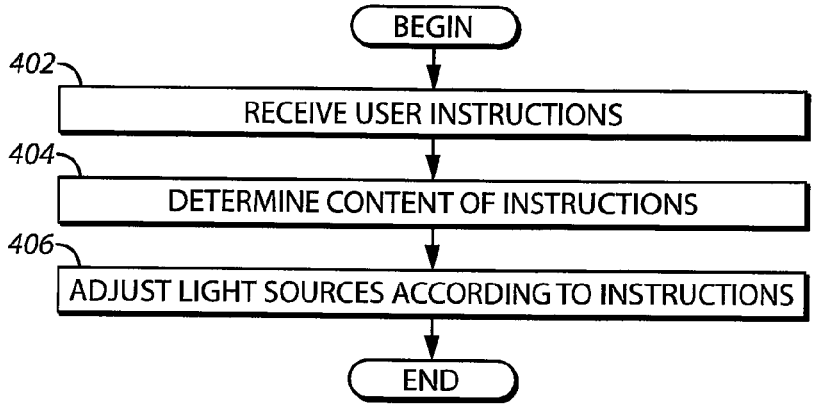
FIG. 8 comprises a flowchart of the operation of a moveable barrier operator having directional light sources according to various embodiments of the present invention.

Referring now to FIG. 8, an approach for operating a moveable barrier operator having directional light sources is described. At step 402, user instructions are received by the moveable barrier operator. The instructions may be received wirelessly from a portable transmitter, from an attached keypad, from a computer, via the Internet, or as received and recognized speech from a user, to name only a few examples. The instructions may be received from other sources as well. The instructions may also include other information (e.g., commands or codes) that actuates a barrier. Alternatively, this information may be received in separate commands or instructions.

The user instructions may be transmitted in any type of format to the operator and communicate any type of information that is necessary or helpful to adjust the light sources. For instance, the instructions may include any combination of fixed and/or rolling codes. The user instructions may expressly name or identify a particular area to be illuminated or include the identity or identities of the light source or sources needed to illuminate the area or areas (e.g., illuminate the hall using light sources A and B only). In other examples, the user instructions may indicate only the area to be illuminate (e.g., illuminate the hall or illuminate the front of the garage) and may allow the operator to determine the optimum set of light sources used in order to accomplish the desired illumination. In this regard, rules or algorithms may be used to determine an optimum set of light sources to accomplish the illumination of a particular area or areas. Additionally, as mentioned earlier, various characteristics of the light sources (e.g., brightness levels, color, differing durations of illumination of different light sources, differing delays for different light sources with respect to initiating illumination, and so forth) may also be adjusted.

At step 404, the content of the user instructions is determined. For example, the user instructions may specify that all light sources are to be used or a set (or subset) of these light sources may be used. In addition, the instructions may specify the area or areas to illuminate. For example, the area may be a single area, multiple non-overlapping areas, or multiple overlapping areas. Combinations of illuminated areas may also be illuminated by different light sources. For example, a first light source may illuminate a single area, a second light source and a third light source may illuminate multiple overlapping areas, and a fourth light source and a fifth light source may illuminate multiple non-overlapping areas. As mentioned above, an area or areas may be specified (and the identities of the light sources used to illuminate a particular area or areas remain unspecified).

At step 406, the light sources are adjusted according to the received instructions or according to a predetermined adjustment algorithm. To take one example, small adjustment motors may be used to adjust the direction of illumination of the light sources so that the light sources illuminate the areas specified in the instructions. In another example, various combinations of light sources are activated to illuminate different areas. In still other examples, various operating characteristics (e.g., subset color or brightness) of the light sources may also be adjusted.

Referring now to FIGS. 9-12, examples of using directional light sources at a moveable barrier operator to illuminate different areas of interest are described. It will be appreciated that the arrangements, positioning, and numbers of lights illustrated here can be varied to suit the need of a particular user, application, or environment.

Figure 9:
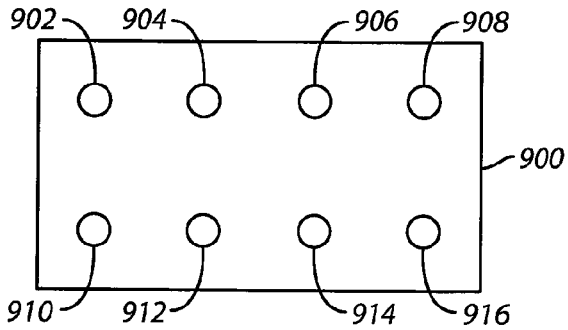
FIG. 9 comprises a diagram of a moveable barrier operator having directional light sources according to various embodiments of the present invention.

Referring now to FIG. 9, an operator 900 includes light sources 902, 904, 906, 908, 910, 912, 914, and 916. The light sources 902, 904, 906, 908, 910, 912, 914, and 916 may be any type of lighting source (conventional light bulb, compact florescent light, or one or more LEDs). The light sources 902, 904, 906, 908, 910, 912, 914, and 916 may also be disposed within recesses in the operator 900 or attached to the surfaces of the operator 900. Instructions may be received (e.g., from portable transmitter or keypad) to activate various combinations of the light sources 902, 904, 906, 908, 910, 912, 914, and 916 at various times. In another example, various events may trigger the activation of light sources in various patterns in a predetermined sequence. For example, the detection of a vehicle (e.g., by detection of a transmission from a portable transmitter) by the operator 900 may trigger certain light sources be activated as the vehicle approaches a garage, other light sources to be activated as the vehicle enters the garage, and still other light sources be activated as the vehicle fully enters and parks in the garage. In this regard, certain groups of light sources may be activated for predetermined periods of time once a trigger event is detected.

Figure 10:
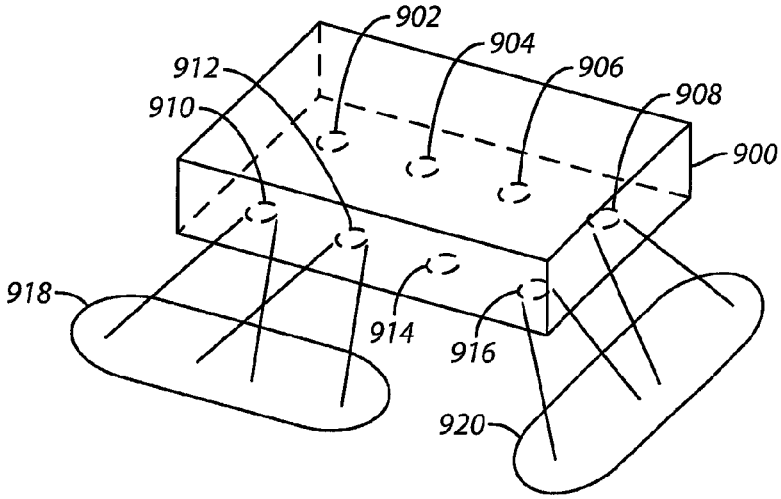
FIG. 10 comprises a diagram of the moveable barrier operator of FIG. 9 having directional light sources to illuminate areas according to various embodiments of the present invention.
Figure 11:
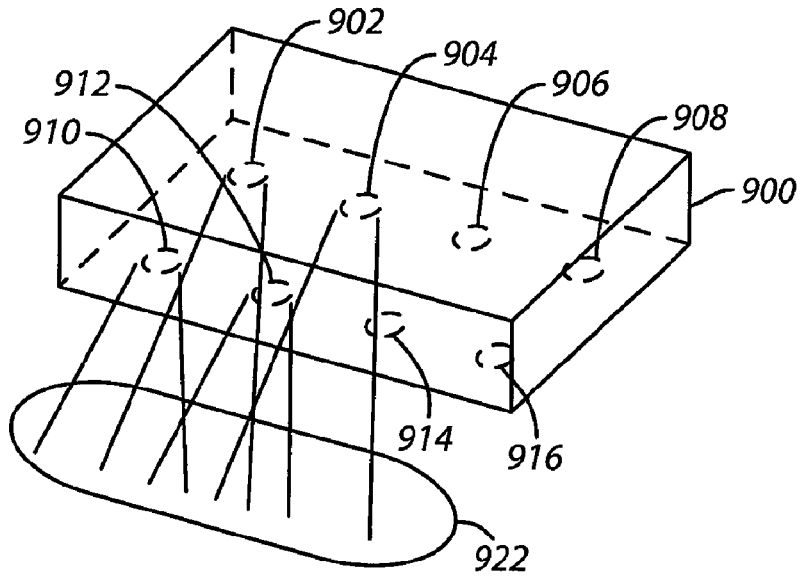
FIG. 11 comprises a diagram of the moveable barrier operator of FIG. 9 having directional light sources to illuminate different areas than those of FIG. 10 according to various embodiments of the present invention.
Figure 12:
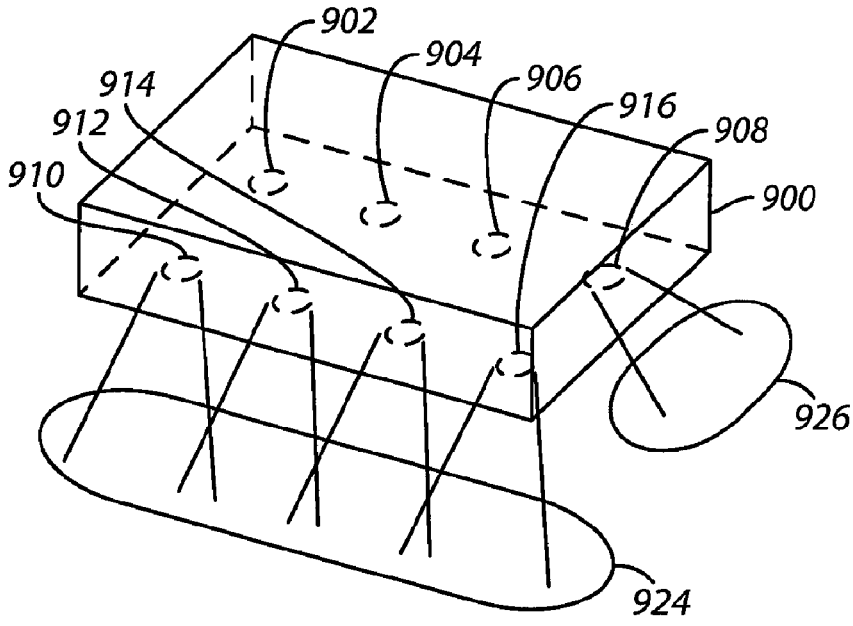
FIG. 12 comprises a diagram of a moveable barrier operator of FIG. 9 having directional light sources to illuminate still different areas than those of FIGS. 10 and 11 according to various embodiments of the present invention.

Referring now to FIG. 10, at a first time, light sources 910 and 912 are activated to illuminate a first area 918 and light sources 908 and 916 are activated to illuminate a second area 920. Light sources 902, 904, 906, and 914 are not activated. Referring now to FIG. 11, at a second time, light sources 902, 904, 910, and 912 are activated to illuminate a third area 922. Light sources 906, 908, 914, and 916 are not activated. Referring now to FIG. 12, at a third time, light sources 910, 912, 914, and 916 are activated to illuminate an area 924 and light source 908 is activated to illuminate an area 926. Light sources 902, 904, and 916 are not activated. It will be appreciated that the number and combinations of light sources described above are examples only and any number and any combination may be used to illuminate different areas.

Thus, approaches are provided whereby light sources are used with a moveable barrier operator and these light sources are automatically directed to illuminate an areas or areas desired by a user. The approaches described herein are flexible and allow a user to illuminate a particular area or areas of interest when requested or needed and then change the illuminated area or areas over time as the needs or requirements of the user change. In so doing, the comfort, security, and safety of the user are enhanced and the individual and time-varying requirements and concerns of the user are met. It will also be understood and appreciated that these teachings are highly scalable and can be used with essentially any number of light sources.

Those skilled in the art will recognize that a wide variety of modifications, alterations, and combinations can be made with respect to the above described embodiments without departing from the spirit and scope of the invention, and that such modifications, alterations, and combinations are to be viewed as being within the scope of the invention.

As but one illustrative example in this regard, by one approach, one or more lights for a given moveable barrier operator may be fixed and unalterable while one or more lights for that moveable barrier operator are adjustable, one way or the other as described herein.

What is claimed is:

1. A moveable barrier operator comprising:

a barrier operator motor for moving a moveable barrier;

a housing disposed around the motor;

a plurality of light emitting diodes coupled to a plurality of adjustment motors, the plurality of light emitting diodes being coupled to the housing along a periphery of the housing and being individually directable by selected one of the plurality of adjustment motors so as to illuminate at least one predetermined area outside the housing, the at least one predetermined area being proximal to a moveable barrier operator;

a receiver configured to receive user instructions; and a controller disposed in the housing and coupled to the motor and the receiver, the controller being arranged and configured to automatically selectively actuate the barrier operator motor to move the moveable barrier according to the received user instructions, and the controller configured to determine an identity of a user associated with the received user instructions and to selectively activate at least one of the plurality of adjustment motors to adjust the direction of illumination of at least some of the plurality of light emitting diodes based upon the determined identity.

2. The moveable barrier operator of claim 1 wherein the plurality of light emitting diodes are configured and arranged to each be individually directable so as to illuminate multiple areas.

3. The moveable barrier operator of claim 2 wherein the multiple areas do not overlap.

4. The moveable barrier operator of claim 2 wherein at least some of the multiple areas overlap.

5. The moveable barrier operator of claim 2 wherein at least one of the plurality of light emitting diodes is individually directable about at least one of two axes.

6. The moveable barrier operator of claim 1 wherein the housing includes a bottom surface and wherein the plurality of light emitting diodes are coupled to a periphery of the bottom surface.

7. The moveable barrier operator of claim 6 wherein the bottom surface includes a plurality of recesses formed therein and the plurality of light emitting diodes are disposed within the plurality of recesses.

8. The moveable barrier operator of claim 1 wherein the housing includes at least one side surface and wherein the plurality of light emitting diodes are secured to a periphery of the at least one side surface.

9. A moveable barrier operator, comprising:

a barrier operator motor configured to move a moveable barrier;

a housing disposed around the motor, the housing dimensioned to be disposed in a confined space;

a plurality of openings in the housing;

a plurality of light emitting diodes, the plurality of light emitting diodes disposed within the housing and being individually directable by a plurality of adjustment motors such that each of the plurality of light emitting diodes is moved by a separate one of the plurality of adjustment motors, the plurality of light emitting diodes being disposed within the openings of the housing and the plurality of adjustment motors being disposed within the housing; and a controller disposed in the housing and coupled to the motor, the controller being arranged and configured to automatically selectively actuate the barrier operator motor to move the movable barrier according to received user instructions.

10. The moveable barrier operator of claim 9 wherein the plurality of light emitting diodes are configured and arranged to each be individually directable so as to illuminate multiple areas.

11. The moveable barrier operator of claim 10 wherein the multiple areas do not overlap.

12. The moveable barrier operator of claim 10 wherein at least some of the multiple areas overlap.

13. The moveable barrier operator of claim 9 wherein the housing includes a bottom surface and wherein the openings are positioned at a periphery of the bottom surface.

14. The moveable barrier operator of claim 9 wherein the housing includes at least one side surface and wherein the opening are positioned along a periphery of the at least one side surface.

15. The moveable barrier operator of claim 9 wherein the controller is configured and arranged to respond, at least in part, to the received user instructions—by selectively controlling at least some of the plurality of adjustment motors to adjust the direction of illumination for at least one of the plurality of light emitting diodes according to an identity of a user associated with the instructions.

16. The moveable barrier operator of claim 9 wherein at least one of the plurality of light emitting diodes is individually directable along at least one of two axes of adjustment.

* * * * *